US007988155B2

(12) United States Patent
Wyrick et al.

(10) Patent No.: US 7,988,155 B2
(45) Date of Patent: Aug. 2, 2011

(54) SUBMACHINE GUN TARGET SYSTEM

(76) Inventors: Bradley Wayne Wyrick, Chapel Hill, NC (US); Lois Schultz Wyrick, Chapel Hill, NC (US); Ruffin Dean Wyrick, Chapel Hill, NC (US)

( * ) Notice: Subject to any disclaimer, the term of this patent is extended or adjusted under 35 U.S.C. 154(b) by 0 days.

(21) Appl. No.: 12/462,185

(22) Filed: Jul. 30, 2009

(65) Prior Publication Data

US 2010/0225063 A1 Sep. 9, 2010

Related U.S. Application Data

(60) Provisional application No. 61/157,977, filed on Mar. 6, 2009.

(51) Int. Cl.
*F41J 1/10* (2006.01)

(52) U.S. Cl. ..... 273/407

(58) Field of Classification Search ..... 273/393, 273/394, 403–410, 390–392; 211/206; 248/156, 248/306

See application file for complete search history.

(56) References Cited

U.S. PATENT DOCUMENTS

| | | | | | |
|---|---|---|---|---|---|
| 1,018,037 | A * | 2/1912 | Dunham | 211/107 |
| 1,103,579 | A * | 7/1914 | Hall | 273/407 |
| 1,455,552 | A * | 5/1923 | Schmidt | 273/393 |
| 3,647,214 | A * | 3/1972 | Hohmann | 273/392 |
| 3,692,188 | A * | 9/1972 | Bayne | 211/59.4 |
| 3,810,624 | A * | 5/1974 | McNemar | 273/354 |
| 4,343,449 | A * | 8/1982 | Osthus | 248/156 |
| 4,907,774 | A * | 3/1990 | Shaw et al. | 248/306 |
| 5,076,032 | A * | 12/1991 | Lehman | 52/169.13 |
| 5,310,193 | A * | 5/1994 | Lowrance | 273/393 |
| 5,881,495 | A * | 3/1999 | Clark | 47/48.5 |
| 6,938,370 | B2 * | 9/2005 | Johns | 47/42 |
| 7,121,418 | B2 * | 10/2006 | Stier | 211/206 |
| 7,318,266 | B2 * | 1/2008 | Bergh | 29/434 |
| 2006/0220318 | A1 * | 10/2006 | Law | 273/407 |
| 2008/0083861 | A1 * | 4/2008 | Conroy et al. | 248/227.3 |

* cited by examiner

*Primary Examiner* — Mark Graham
(74) *Attorney, Agent, or Firm* — Bennet K. Langlotz; Langlotz Patent & Trademark Works, Inc.

(57) ABSTRACT

A submachine gun target system has a target support having a target attachment facility and a target having an attachment element. The target attachment facility may have a first position and a second position, such that the target may be suspended from the target attachment facility with the attachment element residing at the first position or the second position. The target attachment facility may have a retention surface operable to retain the target attachment facility in the first position in response to a bullet strike on the target. The retention surface may be in a forward direction from the second attachment position, such that the retention element does not prevent the target attachment element from being dislodged from the attachment facility when residing at the second position in response to a bullet strike on the target from the forward direction.

11 Claims, 2 Drawing Sheets

SUBMACHINE GUN TARGET SYSTEM

REFERENCE TOP RELATED APPLICATION

This application relates to Provisional Application for patent Ser. No. 61/157,977, filed Mar. 6, 2009, entitled "Submachine Gun Target System."

FIELD OF THE INVENTION

The present invention relates to a submachine gun target system that keeps projectile flak away from the competitive shooter, range officer, and spectators.

BACKGROUND OF THE INVENTION

Getting hit by lead and copper flak is the main problem that shooters, range officers, and spectators have at a submachine gun competition when the bullets hit outdated metal target designs. The conventional target design is a metal plate that is 4 to 10 inches in diameter and ⅜-inch thick with a base plate welded to the bottom so it can stand up on a post with a base plate welded on top. When a bullet hits the traditional design, the plate will fall back, then another bullet could hit in the open area where the target base plate sits on the post base plate, causing flak to be directed back to the shooter and the range officer.

Getting hit by flak generated from a 30 grain wt. up to 230 grain wt. projectile traveling at speeds over 800 feet per second hitting an outdated design steel target has wounded people. It is desirable to develop a safer target system.

Therefore, a need exists for a new and improved submachine gun target system. In this regard, the various embodiments of the present invention substantially fulfill at least some of these needs. In this respect, the submachine gun target system according to the present invention substantially departs from the conventional concepts and designs of the prior art, and in doing so provides an apparatus primarily developed for the purpose of keeping projectile flak away from the competitive shooter, range officer, and spectators.

SUMMARY OF THE INVENTION

The present invention provides an improved submachine gun target system, and overcomes the above-mentioned disadvantages and drawbacks of the prior art. As such, the general purpose of the present invention, which will be described subsequently in greater detail, is to provide an improved submachine gun target system that has all the advantages of the prior art mentioned above.

To attain this, the preferred embodiment of the present invention essentially comprises a target support having a target attachment facility and a target having an attachment element. The target attachment facility may have a first position and a second position, such that the target may be suspended from the target attachment facility with the attachment element residing at the first position or the second position. The target attachment facility may have a retention surface operable to retain the target attachment facility in the first position in response to a bullet strike on the target. The retention surface may be in a forward direction from the second attachment position, such that the retention element does not prevent the target attachment element from being dislodged from the attachment facility when residing at the second position in response to a bullet strike on the target from the forward direction.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
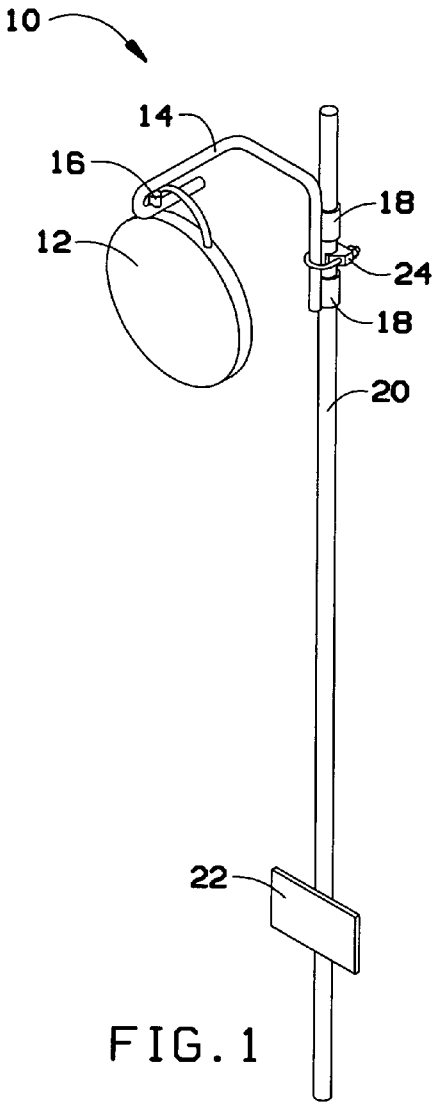
FIG. 1 is a top perspective view of the current embodiment of the submachine gun target system constructed in accordance with the principles of the present invention.
Figure 2:
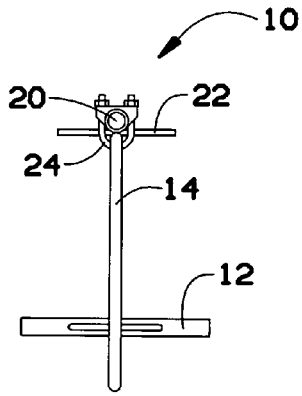
FIG. 2 is a top view of the current embodiment of the submachine gun target system of the present invention.

A preferred embodiment of the submachine gun target system of the present invention is shown and generally designated by the reference numeral 10.

FIG. 1 illustrates improved submachine gun target system 10 of the present invention. More particularly, the target system consists of comprises a hook and post design 14, 20 that holds a hanging metal target 12. A metal round bar post 20 with a small plate 22 welded at the bottom is staked into the ground, and a hook 14 that can be adjusted for height goes over the post 20 holding a target plate 12 to face the competitive shooter.

The post 20 is a round metal bar that is ½ to ¾ inches in diameter and from 3 to 5 feet tall. The attached plate 22 is a metal plate that is 3/16 to 1 inch thick and 3 to 5 inches in both width and length. It is welded to the ½ to ¾ inch round bar post 5 to 8 inches from the bottom end of post so that when the post is staked into the ground, the post will not turn when a projectile hits the metal target.

The hook bar 14, which can be adjusted in height on the post, is a round metal bar of 7/16 to ½ inch diameter that has a bent angle of 38 to 47 degrees for 3 to 6 inches. At this point, there is a 7/16 to 1½ inch bar 3 to 8 inches long with a 38 to 47 degree angle. From that angle the hook bar will go out for 3 to 8 inches to another 38 to 47 degree angle, which will put the top of the hook at around 90 degrees from the post. From the second angle, the hook bar is 3 to 8 inches long with a third radius turn of half a circle (180 degrees). Then, the hook bar will point back to the post.

From the half circle radius turn the bar is 3 to 8 inches long with a ¼ to ¾ inch round bar peg 16 welded on top of the hook bar ½ to 1½ inches from the half circle radius turn. The bar peg allows a metal target, a round circle, square, diamond, or triangle shaped plate 12, of 3×3 inches to 12×12 inches with a thickness of ¼ to 1 inch, to just swing in place when hit. Alternatively, when the target plate is set behind the peg, the metal plate 12 will fall when hit. The ability to choose the target's response to being hit gives the competitive shooter the best of both worlds, an ability that no other target system has ever had.

Figure 5:
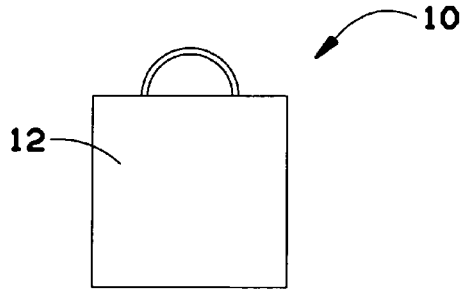
FIG. 5 is a front view of a first alternative embodiment of the target plate of the present invention.
Figure 6:
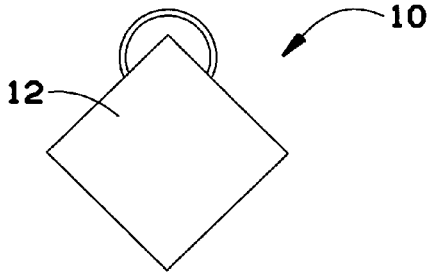
FIG. 6 is a front view of a second alternative embodiment of the target plate of the present invention.
Figure 7:
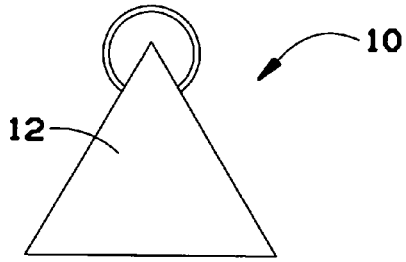
FIG. 7 is a front view of a third alternative embodiment of the target plate of the present invention.

The metal target plate 12, regardless of whether it is a round circle, square (FIG. 5), diamond (FIG. 6), or triangle (FIG. 7), hangs from a welded metal round bar that is ¼ to ½ inch thick and bent to 90 degrees. Both ends point in the same direction to make the shape of a horseshoe that is 1 to 2 inches wide and 1 to 4 inches in height. The "U" shaped metal bar is welded to the top edge of the metal target plate, thus allowing the target plate to hang from the hook.

From the bottom of the hook bar before the first bend on the back side away from the hook side of the bar are two metal rings 18 that are ½ to 1 inch in width and 0.5 to 1.5 inches in height. The rings are welded 1 to 8 inches apart aligned vertically. The rings connect the hook to the post, and a clamp 24 fixes the position of the hook on the post.

The most essential item is for the performance of the target plate of the invention is the hook bar. Although the described post 20 is believed to be the easiest way to mount the hook bar, alternative mounting approaches can be used if necessary.

In use, the target design works by deflecting flak away from the competitor, range officer, and most poorly, the spectators. The main post with the small metal plate welded at the bottom will not allow the target plate on the hook to turn when the target is hit once the post is staked into the ground. The hook can slide up and down for height adjustment on the main post. The hook holds the target plate from the front of the plate, allowing the plate to release off the back of the hook. The round bar hook holding the target plate does not have a flat surface area to generate a mass of flak to return to the shooter, thus deflecting flak away from the shooter, range officers, and spectators.

Figure 3B:
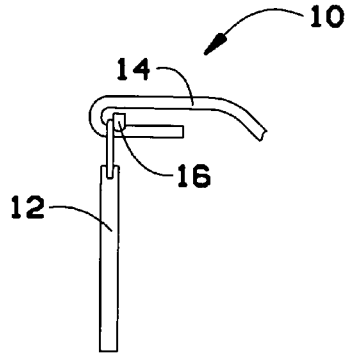
FIG. 3B is a right side fragmentary view of the current embodiment of the submachine gun target system of the present invention.
Figure 3A:
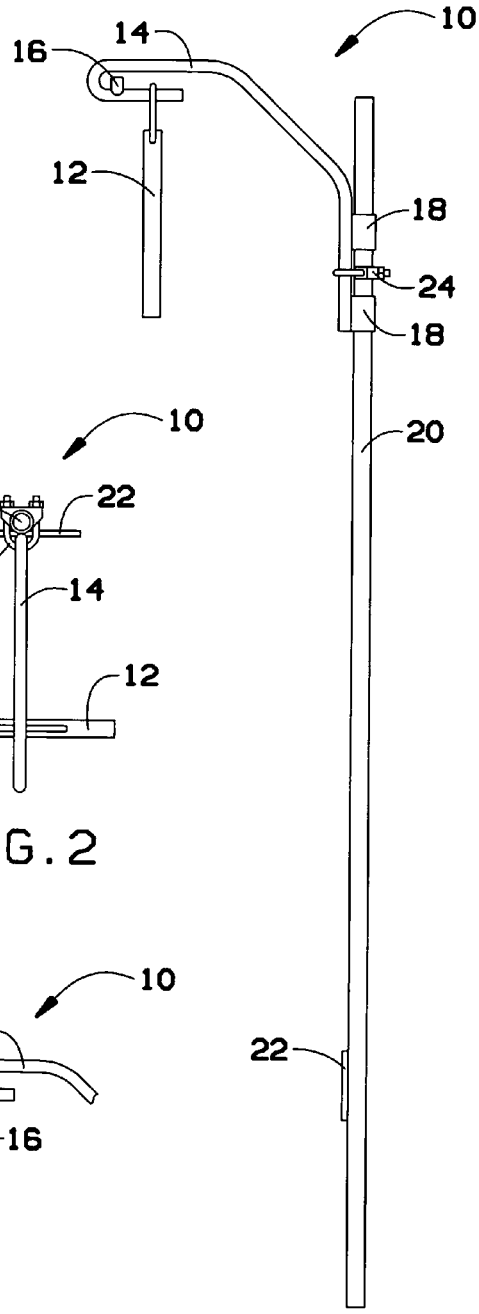
FIG. 3A is a right side view of the current embodiment of the submachine gun target system of the present invention.
Figure 4:
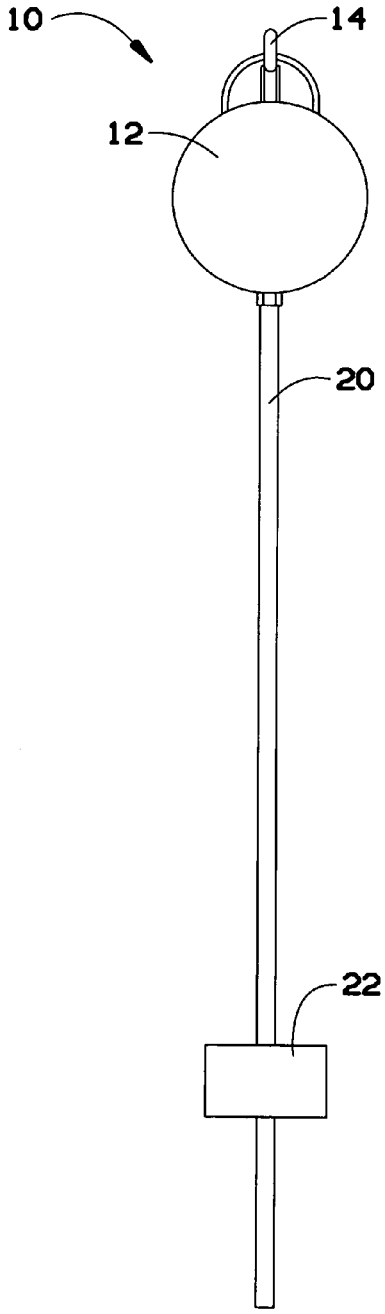
FIG. 4 is a front view of the current embodiment of the submachine gun target system the present invention.

The small peg 16 welded inside of the hook 14 (FIG. 3A) determines if the target plate 12 swings or falls when hit. If the target plate is placed in front of the peg 16 (FIG. 3B), the plate will swing while remaining on the target hook. This enables the shooter to practice continuously without having to reset the target.

However, if the target plate 12 is placed behind the peg 16 (FIG. 3A), the target plate 12 is knocked off when first hit. However, the target plate 12 can also be set on the bar hook to fall off when first hit. This is the desired target behavior for competitive match shooting. Therefore, the current invention allows the shooter to use the same apparatus for both competitive shooting and personal practice shooting.

A metal fabrication process, using a metal bender to shape a round metal bar, makes the bar hook portion of the target system. After the bar hook is made, metal rings 18 are welded to it so that the hook 14 can be placed onto the main post 20, and a small metal peg 16 is welded onto the inside of the bar hook 14 to hold a metal target plate 12 in place.

This submachine gun target system is simple to use and effective at preventing flak rebound. Everyone from a beginner to the most experienced shooter can use the current invention to set up a safe metal target system to practice with or to run a complete shooting match as a match director or range officer.

The current invention is designed so that all of its parts will fit within the average car trunk. The combined weight of the target plate 12, hanger hook 14, main post 20, and clamp 24 is about 3 lbs. Conventional target systems typically are left at the gun range because they are heavy and require more than one person to handle them. In contrast, a person can fit up to 15 target systems of the current invention in the back of a car and get to the range with ease. He or she can then ready the target system for use by taking the main post and stepping on the attached small metal plate to push the post into the ground. If the ground is hard, he or she can use a common hammer and tap it on the top of the small metal plate 22 close to the bottom of the main post 20. Once the post is installed, the hanger hook 14 is placed over the main post 20, using the metal rings 18, and it is adjusted to the desired height and secured in place by the clamp 24. A metal target plate 12 is placed onto the hanger hook 14. Additional target systems can be placed anywhere one chooses. When 5 to 15 are placed, a very impressive safe shooting gallery is created.

A person can practice with the target plates 12 set to not fall when hit, enabling continuous shooting without requiring the shooter to stop and reset the targets. Once the shooter has practice to reach his or her desired level of skill, the metal target plates can be set to drop off when shot. This is the objective of steel plate match shooting: knocking down metal targets as fast as possible. The fastest accurate shooter wins. For reasons of personal defense, the most accurate fastest (would-be victim) shooter wins against a criminal's attacks.

The current invention was tested by constructing a large cardboard box that completely surrounded the target plate. A picture of the target plate was drawn on the front facing cardboard panel directly in front of the target plate. An ATF legal form 4 class 3 HK MP5K submachine gun (900 rounds per minute) with a 72 round full auto drum magazine dump was then used to engage the target through the front facing cardboard panel by aiming at the drawing.

The cardboard test revealed that the cardboard panel placed below the target plate experienced the most damage from flak hits. The cardboard panels positioned to the left and right sides of the target plate suffered damage to their bottom thirds. The cardboard panel placed above the target plate had only minimal damage, and the cardboard panel placed directly in front of the target plate showed no visible flak damage other than the initial penetrations by the incoming rounds. A depression from flak hits in the ground below the target plate that was 3 inches wide by 3 feet long has also been observed in use.

The target system has also been tested in the same manner using numerous other submachine guns with and without sound suppressors as follows: Colt AR15 model 614 9 mm/223 (700 rounds per minute), IMI Standard SMG UZI 9 mm/45acp (600 rounds per minute), IMI Mini SMG UZI 9 mm (1100 rounds per minute), Smith & Wesson model 76 (800 rounds per minute), German MP40 (550 rounds per minute), Gemtech TPR-S.308, Gemtech 223 HALO, Gemtech Massod (2) 9 mm, Gemtech MK9K 9 mm, Gemtech SG-9 9 mm, Gemtech Seahunter 22LR, AWC MK9-UZI mount 45acp, PAI model SO-9 wet suppressor 9 mm. Similar results to those obtained with the HK MP5K submachine gun were observed.

Two characteristics of the target system are believed to be responsible for the test results. When the projectile hits the target plate, the projectile flattens and separates into flak. As the bullet separates, the resulting flak goes outwards from the center of where it struck the target plate. The first characteristic of the target system that influences flak direction is that the only surfaces the flak can hit and be deflected by are the post, hook bar, and the bar welded to the top of the target. The no more than ½ inch in diameter round rods used for these components eliminate flat surfaces. Their diameter provides insufficient forward facing surface area to cause flak to be reflected towards the shooter. In addition, their curved surface deflects flak to the sides, so any flak striking the round rods continues moving in a similar direction to the originating bullet.

The second characteristic is that when the target plate is hit by a bullet, enough friction exists between the hook bar and the bar welded to the top of the target plate to cause the bottom end of the target plate to achieve a greater speed and travel a longer distance than the top of the target plate even if the target plate is hit above its midpoint. As this happens, the bullet flattens and separates outward 90 degrees from the surface of the target plate. Since the bottom of the target plate has tilted so that the target faces downwards in response to the bullet strike and the drag from the hook bar exerted on its top, the resulting flak is directed downwards to the ground. Because the angle of tilt is greater when the target plate is struck in its middle or below, the ground and the bottom cardboard panel directly beneath the target receive the most damage when this occurs.

While a current embodiment of the submachine gun target system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A gun target system comprising:

a target support having a target attachment facility;

a plate metal ballistic target having an attachment element;

the target attachment facility having a first position and a second position, such that the target may be suspended from the target attachment facility with the attachment element residing at the first position or the second position;

the target attachment facility having a retention element operable to retain the target attachment element in the first position in response to a bullet strike on the target;

the retention element being in a forward direction from the second attachment position, such that the retention element does not prevent the target attachment element from being dislodged from the attachment facility when residing at the second position in response to a bullet strike on the target from the forward direction; and wherein the target attachment facility limits upward movement of the target attachment element.

2. The target system of claim 1, further comprising the target attachment facility being a horizontal surface at the second position, upon which the attachment element rests.

3. The target system of claim 2, further comprising the horizontal surface having a free end extending rearward, such that the target attachment element may slide off the free end in response to a bullet strike.

4. The target system of claim 1, further comprising the retention element comprising an elevated element to the rear of the attachment element.

5. The target system of claim 1, further comprising the attachment element being positioned at an upper portion of target, such that the target is operable to hang from the attachment element.

6. A gun target system comprising:

a target support having a target attachment facility;

a plate metal ballistic target having an attachment element;

the attachment element hanging from the target attachment facility;

the target attachment facility having a support surface that receives the target's attachment element;

a rear end of the support surface comprising a free end, such that the target attachment element is free to slide rearwardly off the support surface in response to a bullet strike from a forward direction;

wherein the target attachment facility limits upward movement of the target attachment element;

wherein the support surface is horizontal;

a retention element defined by a deviation in the support surface;

the target attachment facility having a first position and a second position defined by the retention element, such that the target may be suspended from the target attachment facility with the attachment element residing at the first position or the second position;

the retention element operable to retain the target attachment element in the first position in response to an bullet strike on the target; and the retention element being in a forward direction from the second attachment position, such that the retention element does not prevent the tar et attachment element from being dislodged from the attachment facility when residing at the second position in response to a bullet strike from the forward direction.

7. The target system of claim 6, further comprising:

the free end of the support surface being separated from the remainder of the target support by an open channel, such that the target attachment element is free to slide rearwardly off the support surface in response to a bullet strike from a forward direction.

8. A gun target system comprising:

a target support having one end connected to a target attachment facility;

a plate metal ballistic target having an attachment element at an upper portion hanging pivotally from the target attachment facility;

the target support and target attachment facility comprising rods that are circular in cross-section, thereby presenting a curved surface in all directions;

wherein striking the target with a bullet from a forward direction causes the target and attachment element to move in a rearward direction;

wherein friction between the attachment element and the target support creates drag on the target's upper end that causes the target's bottom end to tilt so that the target faces downwards;

wherein the target attachment facility limits upward movement of the target attachment element;

the target attachment facility having a support surface that receives the target's attachment element;

a retention element being defined by a deviation in the support surface, the target attachment facility having a first position and a second position defined by the retention element, such that the target may be suspended from the target attachment facility with the attachment element residing at the first position or the second position;

the retention surface element operable to retain the target attachment element in the first position in response to an bullet strike on the target; and the retention element being in a forward direction from the second attachment position, such that the retention element does not prevent the target attachment element from being dislodged from the attachment facility when residing at the second position in response to a bullet strike from the forward direction.

9. The target system of claim 8, further comprising:

the vertical element of the target support terminating in a ground probe portion opposite the target attachment facility;

a blade connected to the ground probe portion of the target support;

wherein the blade extends outward from the vertical element;

wherein pressure is applied to the top of the blade to drive the ground probe portion into the ground; and wherein the blade penetrates the ground and prevents rotation of the vertical element when the target is struck.

10. The target system of claim 8, further comprising:

the rear of the support surface being separated from the remainder of the target support by an open channel;

the open channel enabling the target's attachment facility to slide off the support surface when the target is struck from the front.

11. A gun target system comprising:

a target support having a target attachment facility;

a plate metal ballistic target having an attachment element;

the target attachment haying a first position and a second position, such that the target may be suspended from the target attachment facility with the attachment element residing at the first position or the second position;

the target attachment facility having a retention element operable to retain the target attachment element in the first position in response to a bullet strike on the target;

the retention element being in a forward direction from the second attachment position, such that the retention element does not prevent the target attachment element from being dislodged from the attachment facility when residing at the second position in response to a bullet strike on the target from the forward direction;

wherein the target attachment facility limits upward movement of the target attachment element; and wherein the target attachment facility is U-shaped comprising a stem extending forward and a free end with support areas extending backwards.

* * * * *